US011520274B2

(12) United States Patent
Takagami et al.

(10) Patent No.: US 11,520,274 B2
(45) Date of Patent: Dec. 6, 2022

(54) CLEANING DEVICE CAPABLE OF PREVENTING SOLIDIFICATION OF TONER AND IMAGE FORMING APPARATUS INCLUDING THE SAME

(71) Applicant: KYOCERA Document Solutions Inc., Osaka (JP)

(72) Inventors: Ai Takagami, Osaka (JP); Yosuke Saito, Osaka (JP); Nobuyuki Hayashi, Osaka (JP); Masaki Kadota, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/694,430

(22) Filed: Mar. 14, 2022

(65) Prior Publication Data

US 2022/0308519 A1 Sep. 29, 2022

(30) Foreign Application Priority Data

Mar. 26, 2021 (JP) ..... JP2021-053187

(51) Int. Cl.
*G03G 21/00* (2006.01)
*G03G 21/10* (2006.01)

(52) U.S. Cl.
CPC ..... *G03G 21/00* (2013.01); *G03G 21/105* (2013.01)

(58) Field of Classification Search
CPC ..... G03G 21/10; G03G 21/105
USPC ..... 399/358
See application file for complete search history.

(56) References Cited

U.S. PATENT DOCUMENTS

| | | | | |
|---|---|---|---|---|
| 6,832,067 | B2 * | 12/2004 | Kubo | G03G 21/105 399/358 |
| 9,996,046 | B2 * | 6/2018 | Oi | G03G 21/105 |
| 10,268,154 | B2 * | 4/2019 | Ohsugi | G03G 21/105 |
| 2022/0308501 | A1 * | 9/2022 | Kadota et al. | G03G 15/105 |
| 2022/0308518 | A1 * | 9/2022 | Saito et al. | G03G 21/0011 |

FOREIGN PATENT DOCUMENTS

JP 2008-158170 A 7/2008

* cited by examiner

*Primary Examiner* — William J Royer
(74) *Attorney, Agent, or Firm* — Stein IP, LLC

(57) ABSTRACT

A cleaning device includes a housing, a cleaning blade, a toner conveyance path, a conveyance screw, and a first flicker. The conveyance screw includes a rotary shaft and a helical vane. The first flicker includes a first base portion and a plurality of first contact pieces and uses the first contact pieces to press the conveyance screw in a first direction away from a bottom part of the toner conveyance path. The first base portion includes a secured portion and a blade opposed portion. The first contact pieces are connected to an upper end part of the blade opposed portion. An elastic member is disposed between the cleaning blade and the blade opposed portion.

7 Claims, 4 Drawing Sheets

CLEANING DEVICE CAPABLE OF PREVENTING SOLIDIFICATION OF TONER AND IMAGE FORMING APPARATUS INCLUDING THE SAME

INCORPORATION BY REFERENCE

This application is based upon and claims the benefit of priority from the corresponding Japanese Patent Application No. 2021-053187 (filed on Mar. 26, 2021), the entire contents of which are incorporated herein by reference.

BACKGROUND

The present disclosure relates to a cleaning device and an image forming apparatus including the same.

In an image forming apparatus (a copy machine, a printer, a facsimile, or the like) using an electrophotographic method, an electrostatic latent image formed on an image carrier (a photosensitive drum or the like) is developed into a visual toner image by using toner (a powdery developer) in a developing device, and this toner image is transferred onto a recording medium directly or via an intermediate transfer member and then is subjected to fixing processing. In the image forming apparatus thus configured, there is mounted a cleaning device for removing residual toner on a surface of the image carrier or the intermediate transfer member.

The cleaning device described above includes a toner removing mechanism, a housing, and a conveyance screw. The toner removing mechanism removes residual toner on the surface of the image carrier. In the housing, there is formed a toner conveyance path for conveying waste toner removed. The conveyance screw conveys waste toner in the toner conveyance path to a waste toner collection container provided outside the housing. The housing has an opening that is formed at a position thereon overlapping the surface of the image carrier and through which waste toner is introduced into the toner conveyance path.

Meanwhile, there is a fear that when subjected to mechanical stress, waste toner might become uneven in terms of its particle shape and the degree of adhesion of an external additive thereto, thus deteriorating in flowability. Moreover, intrusion of paper dust or the like into waste toner might cause the waste toner to further deteriorate in flowability and thus become likely to be solidified. Furthermore, with toner having lower melting points in recent years, flowability of the toner is more likely to be decreased under a high-temperature environment. This has led to a problem that, particularly in a high-temperature and high-humidity environment, waste toner having decreased flowability might be solidified around the conveyance screw (for example, between helical blades) provided in the toner conveyance path, bringing about a so-called blocking state in which toner can hardly be conveyed.

To address this problem, various methods for suppressing the blocking state brought about by waste toner have been proposed, an example of which uses a cleaning device adopting a configuration in which a flicker in the shape of a plurality of films is made to abut on a conveyance screw.

The flicker is provided over an entire region of the conveyance screw in an axis direction thereof. The flicker abuts on the conveyance screw and presses, at a location of the abutment, the conveyance screw toward a bottom part of a toner conveyance path. As the conveyance screw rotates, the flicker assumes, in a repeated and reciprocating manner, a state of being lifted by the helical blades of the conveyance screw to be elastically deformed and a state of abutting on a rotary shaft of the conveyance screw under resilience and thus swings while being elastically deformed correspondingly to a rotation cycle of the rotary shaft. The conveyance screw rotates in a state where the flicker abuts thereon in this manner, so that waste toner adhering to the conveyance screw is scraped off by the flicker, thus being unlikely to stick to the conveyance screw.

SUMMARY

A cleaning device according to one aspect of the present disclosure includes a housing, a cleaning blade, a toner conveyance path, a conveyance screw, and a first flicker. The housing has an opening that is formed to be opposed to an outer circumferential surface of an image carrier and through which waste toner removed from the outer circumferential surface of the image carrier is introduced inside the housing. The cleaning blade protrudes through the opening toward the outer circumferential surface of the image carrier and has a distal end part that abuts on the outer circumferential surface of the image carrier. The toner conveyance path is provided in a bottom part of the housing and conveys the waste toner introduced through the opening. The conveyance screw includes a rotary shaft rotatably supported inside the toner conveyance path and a helical vane formed on an outer circumferential surface of the rotary shaft. The first flicker is provided between the rotary shaft and the cleaning blade in a horizontal direction and includes a first base portion extending in a direction of the rotary shaft and a plurality of first contact pieces extending from the first base portion toward the conveyance screw to abut on a lower part of an outer circumferential surface of the conveyance screw relative to the rotary shaft and arranged along the rotary shaft direction. The first flicker uses the first contact pieces to press the conveyance screw in a first direction away from a bottom part of the toner conveyance path. The first base portion includes a secured portion secured to an inner wall of the housing and a blade opposed portion extending upward from the secured portion to be opposed to the cleaning blade in the horizontal direction. The first contact pieces are connected to an upper end part of the blade opposed portion. An elastic member is disposed between the cleaning blade and the blade opposed portion.

DETAILED DESCRIPTION

Figure 1:
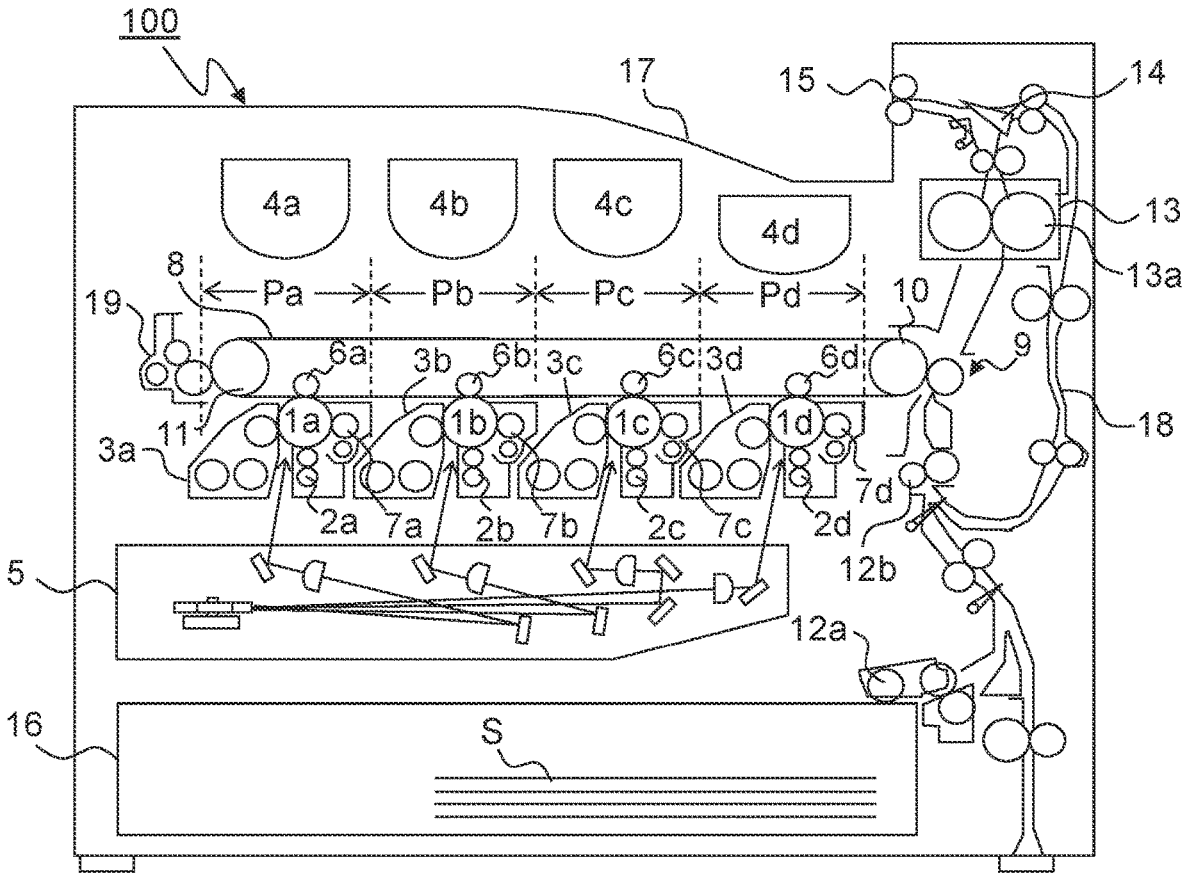
FIG. 1 is a schematic sectional view of an image forming apparatus in which a cleaning device of the present disclosure is mounted.

With reference to the appended drawings, the following describes a first embodiment of cleaning devices 7*a* to 7*d* of the present disclosure and an image forming apparatus 100. FIG. 1 is a schematic sectional view of the image forming apparatus 100 in which the cleaning devices 7*a* to 7*d* of the present disclosure are mounted. In a main body of the image forming apparatus 100, four image forming portions Pa, Pb, Pc, and Pd are provided in order from an upstream side (a left side in FIG. 1) in a conveyance direction. The image forming portions Pa to Pd are provided so as to correspond to images of four different colors (magenta, cyan, yellow, and black) and individually perform steps of charging, exposure, development, and transfer so as to sequentially form images of magenta, cyan, yellow, and black, respectively.

In the image forming portions Pa to Pd, photosensitive drums 1*a*, 1*b*, 1*c*, and 1*d* (image carriers) are provided, respectively, to carry visible images (toner images) of the respective colors. Moreover, an intermediate transfer belt 8 that rotates in a counterclockwise direction in FIG. 1 is provided adjacently to the image forming portions Pa to Pd. Toner images formed respectively on the photosensitive drums 1*a* to 1*d* are sequentially transferred onto the intermediate transfer belt 8 moving while abutting on the photosensitive drums 1*a* to 1*d* and then are transferred at a time onto a sheet S as an example of a recording medium in a secondary transfer unit 9. Moreover, the toner images are fixed on the sheet S in a fixing portion 13, and then the sheet S is discharged from the main body of the image forming apparatus 100. An image forming process with respect to the photosensitive drums 1*a* to 1*d* is executed while the photosensitive drums 1*a* to 1*d* are rotated in a clockwise direction in FIG. 1.

The sheet S on which toner images are to be transferred is contained in a sheet cassette 16 disposed in a lower part in the image forming apparatus 100 and is conveyed to the secondary transfer unit 9 via a paper feed roller 12*a* and a registration roller pair 12*b*.

Next, a description is given of an image forming procedure performed in the image forming apparatus 100. Upon a user's input to start image formation, first, the photosensitive drums 1*a* to 1*d* are started to rotate by a main motor (not shown), and a surface of each of the photosensitive drums 1*a* to 1*d* is uniformly charged by a charging roller 21 (see FIG. 2) of a corresponding one of charging devices 2*a* to 2*d*. Then, electrostatic latent images corresponding to an image signal are formed on the photosensitive drums 1*a* to 1*d*, respectively, by beam light (laser light) emitted from an exposure device 5.

Developing devices 3*a* to 3*d* are filled with prescribed amounts of toner of the respective colors of magenta, cyan, yellow, and black, respectively. In a case where a percentage of toner in a two-component developer filled in each of the developing devices 3*a* to 3*d* falls below a preset value due to after-mentioned toner image formation, the developing devices 3*a* to 3*d* are replenished with toner from toner containers 4*a* to 4*d*, respectively. The toner in the developer is supplied on each of the photosensitive drums 1*a* to 1*d* by a developing roller 25 (see FIG. 2) of a corresponding one of the developing devices 3*a* to 3*d* and electrostatically adheres thereto. Thus, there are formed toner images corresponding to the electrostatic latent images on the photosensitive drums 1*a* to 1*d*, respectively.

Further, each of primary transfer rollers 6*a* to 6*d* applies an electric field at a prescribed transfer voltage between itself and a corresponding one of the photosensitive drums 1*a* to 1*d* so that the toner images of magenta, cyan, yellow, and black on the photosensitive drums 1*a* to 1*d* are primarily transferred onto the intermediate transfer belt 8. These images of the four different colors are formed in a prescribed positional relationship predetermined for formation of a prescribed full-color image. After that, residual toner remaining on the surface of each of the photosensitive drums 1*a* to 1*d* is removed by a cleaning blade 28 (see FIG. 2) of a corresponding one of the cleaning devices 7*a* to 7*d* in preparation for subsequent formation of a new electrostatic latent image.

When the intermediate transfer belt 8 starts to rotate in the counterclockwise direction as a driving roller 10 is driven to rotate by a belt driving motor (not shown), at prescribed timing, the sheet S is conveyed from the registration roller pair 12*b* to the secondary transfer unit 9 provided adjacently to the intermediate transfer belt 8, where a full-color image is transferred on the sheet S. The sheet S on which toner images have been transferred is conveyed to the fixing portion 13. Residual toner remaining on a surface of the intermediate transfer belt 8 is removed by a belt cleaning unit 19.

The sheet S thus conveyed to the fixing portion 13 is heated and pressed by a fixing roller pair 13*a* so that the toner images are fixed on a surface of the sheet S, and thus a prescribed full-color image is formed thereon. A conveyance direction of the sheet S on which the full-color image has been formed is controlled by a branch portion 14 branching off in a plurality of directions, and thus the sheet S is directly (or after being conveyed to a double-sided conveyance path 18 and subjected to double-sided printing therein) discharged to a discharge tray 17 by a discharge roller pair 15.

Figure 2:
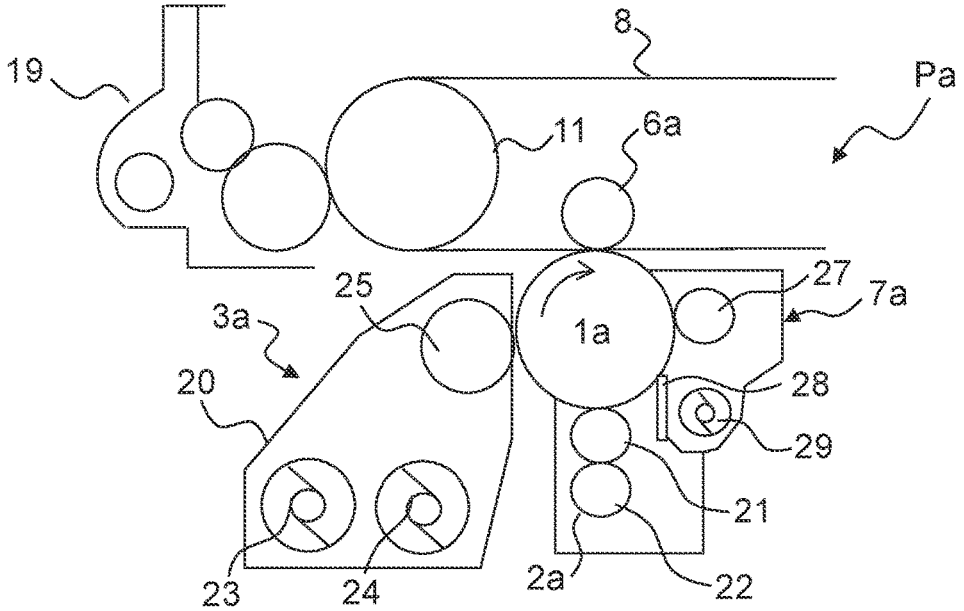
FIG. 2 is an enlarged View of a vicinity of an image forming portion shown in FIG. 1.
Figure 3:
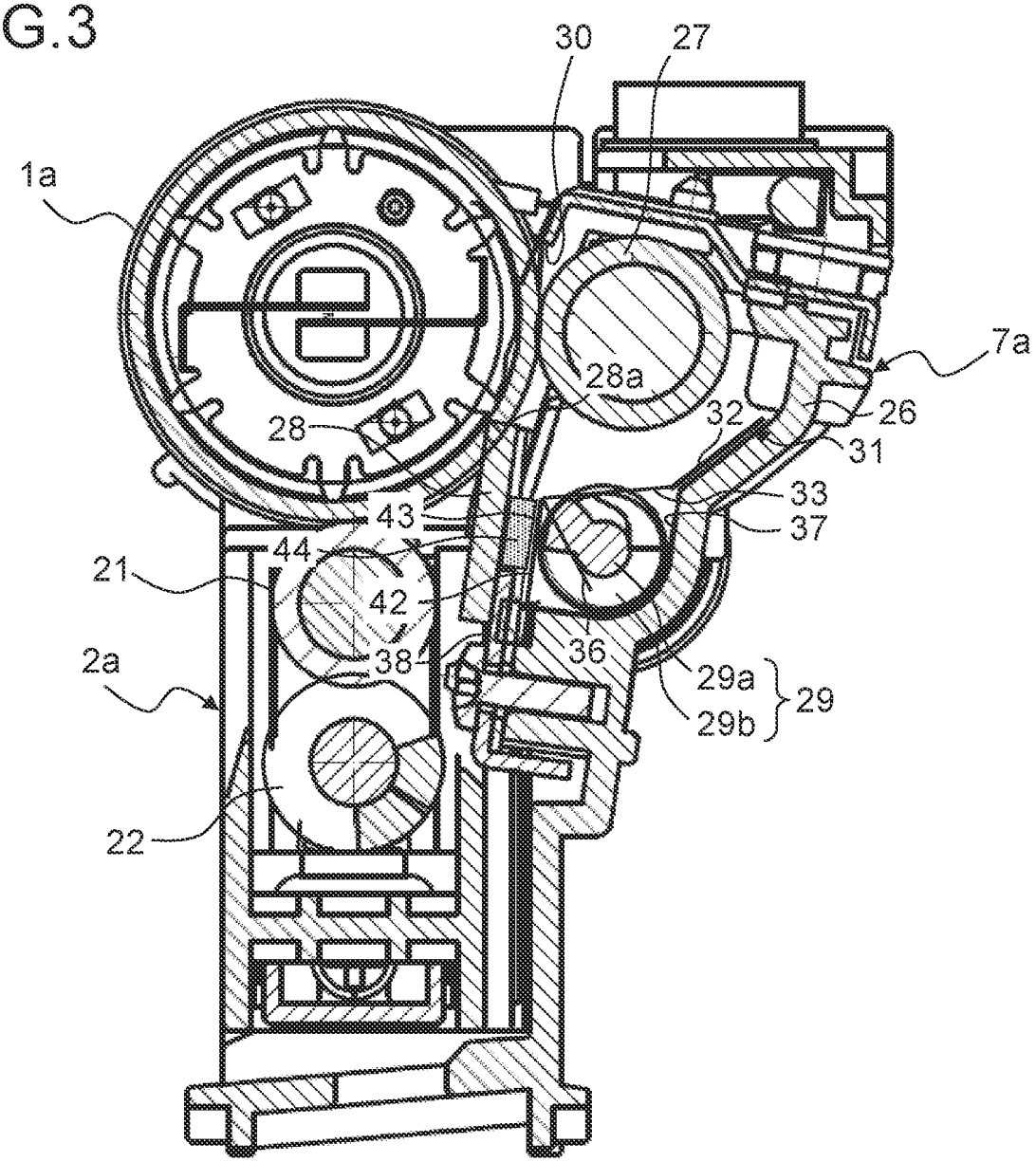
FIG. 3 is a side sectional view showing a configuration of surroundings of a cleaning device according to an embodiment of the present disclosure shown in FIG. 2.
Figure 4:
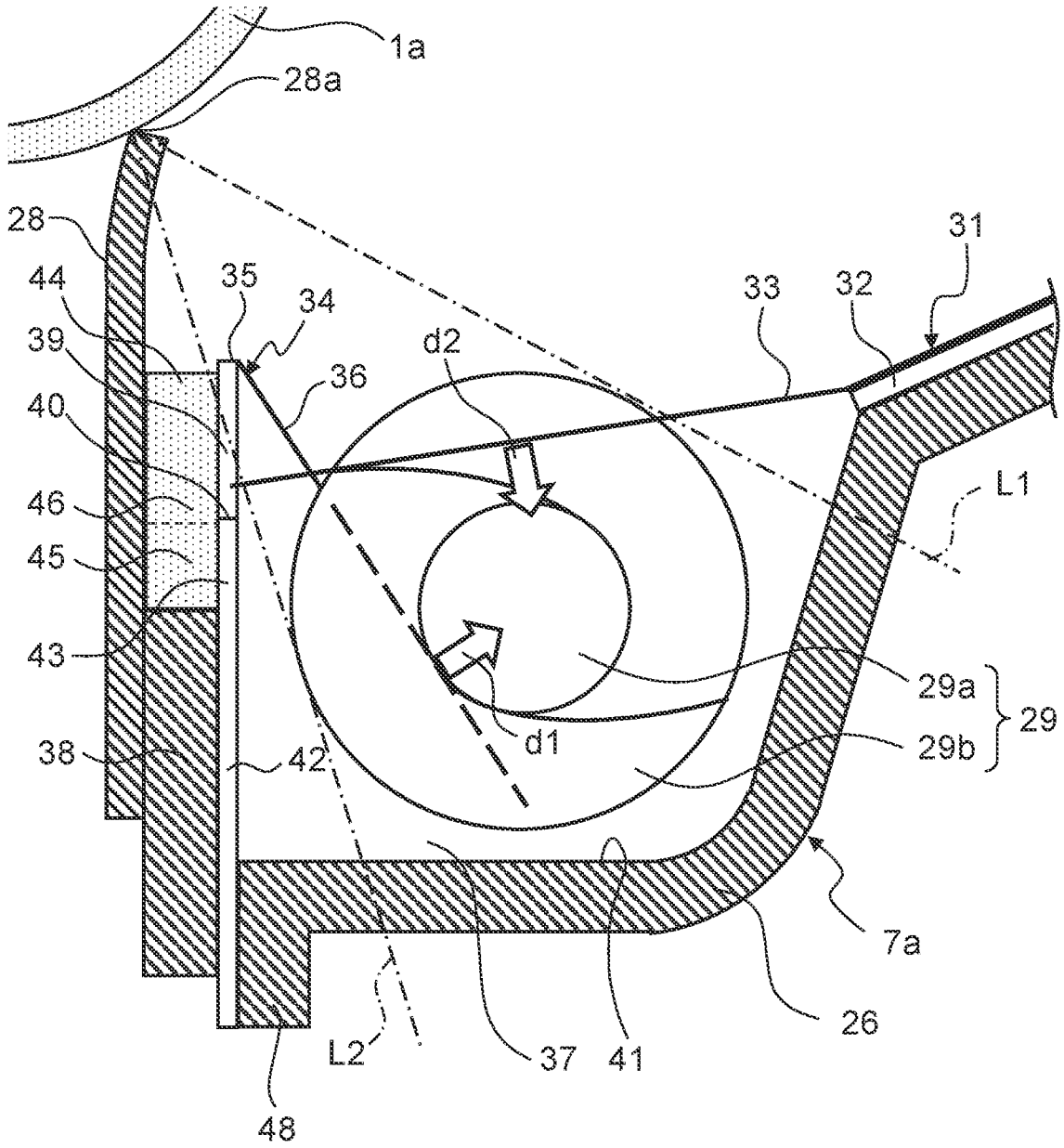
FIG. 4 is a sectional view of a first flicker and a second flicker shown in FIG. 3 as cut in a direction orthogonal to an axis direction.

FIG. 2 is an enlarged view of a vicinity of the image forming portion Pa shown in FIG. 1. FIG. 3 is a side sectional view showing a configuration of surroundings of the cleaning device 7*a* according to the embodiment of the present disclosure shown in FIG. 2. FIG. 4 is a sectional view of a first flicker 34 and a second flicker 31 shown in FIG. 3 as cut in a direction orthogonal to an axis direction. The following describes in detail the image forming portion Pa including the photosensitive drum 1*a*, the charging device 2*a*, and the cleaning device 7*a*. The image forming portions Pb to Pd are similar in configuration to the image forming portion Pa, and thus descriptions thereof are omitted, while components in common are denoted by identical reference signs.

As shown in FIG. 2, around the photosensitive drum 1*a*, there are provided the charging device 2*a*, the developing device 3*a*, and the cleaning device 7*a* along a drum rotation direction (a clockwise direction in FIG. 2), and the primary transfer roller 6*a* is disposed to face the photosensitive drum 1*a* via the intermediate transfer belt 8. Furthermore, the belt cleaning unit 19 is disposed on an upstream side in a rotation direction of the intermediate transfer belt 8 with respect to the photosensitive drum 1*a*. The belt cleaning unit 19 is opposed to a tension roller 11 via the intermediate transfer belt 8.

The photosensitive drum 1*a* includes an aluminum drum tube and a photosensitive layer stacked on an outer circumferential surface of the drum tube. As the photosensitive layer, there is used, for example, an organic photosensitive layer (OPC) using an organic photoconductor or an inorganic photosensitive layer such as an amorphous silicon (a-Si) photosensitive layer formed by evaporation of silane gas or the like.

The charging device 2*a* includes the charging roller 21 and a brush roller 22. The charging roller 21 makes contact with the photosensitive drum 1*a* to apply a charging bias to a drum surface thereof. The brush roller 22 performs cleaning of the charging roller 21.

The developing device 3*a* includes, in a developing container 20, two stirring conveyance members composed of a stirring conveyance screw 23 and a supply conveyance screw 24, and the developing roller 25. The developing device 3*a* causes toner carried on a surface of the developing roller 25 to fly to the surface of the photosensitive drum 1*a* so that the toner is used to develop an electrostatic latent image into a toner image.

As shown in FIG. 2 and FIG. 3, the cleaning device 7*a* includes a housing 26 and a toner conveyance path 37, and the housing 26 houses therein a rubbing roller 27, the cleaning blade 28, a conveyance screw 29, the First flicker 34, and the second flicker 31. The housing 26 is adjacent to the photosensitive drum 1*a* in a horizontal direction and has an opening 30 formed at a location of the adjacency to the photosensitive drum 1*a*. The toner conveyance path 37 is formed in a bottom part of the housing 26. The toner conveyance path 37 contains waste toner introduced through the opening 30.

The rubbing roller 27 is rotatably and axially supported to side plates (not shown) of the housing 26 in a front-rear direction thereof (a direction perpendicular to a paper plane of FIG. 3), The rubbing roller 27 abuts on the surface (an outer circumferential surface) of the photosensitive drum 1*a* via the opening 30. By an unshown driver, the rubbing roller 27 is driven to rotate in an identical direction (a following direction) with respect to the photosensitive drum 1*a* on a surface thereof on which it abuts on the photosensitive drum 1*a*. The rubbing roller 27 is driven to rotate in this manner, thus removing residual toner on the surface of the photosensitive drum 1*a* and also rubbing and polishing the surface of the photosensitive drum 1*a*. The residual toner removed by the rubbing roller 27 is introduced as waste toner into the toner conveyance path 37 in the housing 26 through the opening 30.

The rubbing roller 27 is controlled to have a linear velocity higher (for example, by a factor of 1.2) than a linear velocity of the photosensitive drum 1*a*. The rubbing roller 27 has, for example, a structure including a metal shaft around which a foam layer of EPDM rubber having an Asker C hardness of 55° is formed as a roller body. The roller body is not limited in material to EPDM rubber and may be made of any other type of rubber or formed of a foamed rubber body. Favorably used is a material having an Asker C hardness in a range of 10° to 90°.

As shown in FIG. 3 and FIG. 4, among a plurality of walls constituting the housing 26, a blade securing wall 38 rises up from a side end part of a bottom surface 41 of the toner conveyance path 37 on a side near the photosensitive drum 1*a* in the horizontal direction. The cleaning blade 28 is secured to the blade securing wall 38. The cleaning blade 28 protrudes from the blade securing wall 38 toward the opening 30.

A distal end part 28*a* of the cleaning blade 28 is in contact with the outer circumferential surface of the photosensitive drum 1*a* while being pressed thereagainst. As the photosensitive drum 1*a* rotates, toner on the outer circumferential surface of the photosensitive drum 1*a* is scraped off by the distal end part 28*a* of the cleaning blade 28. The distal end part 28*a* of the cleaning blade 28 is positioned on a downstream side of an abutment portion between the photosensitive drum 1*a* and the rubbing roller 27 in the rotation direction of the photosensitive drum 1*a* (a clockwise direction in FIG. 3).

As the cleaning blade 28, there is used, for example, a polyurethane rubber blade having a JIS hardness of 78° and a thickness of 2 mm. A material, hardness, and dimensions of the cleaning blade 28, a mounting angle thereof with respect to the photosensitive drum 1*a*, a biting amount thereof into the photosensitive drum 1*a*, a pressure contact force against the photosensitive drum 1*a*, and so on are set appropriately depending on specifications of the photosensitive drum 1*a*.

The conveyance screw 29 includes a rotary shaft 29*a* and a helical vane 29*b*. The rotary shaft 29*a* is disposed in the toner conveyance path 37. The rotary shaft 29*a* is rotatably supported to the side plates of the housing 26 in the front-rear direction. The helical vane 29*b* is a spiral-shaped vane integrally formed on an outer circumferential surface of the rotary shaft 29*a*. As the conveyance screw 29 rotates, waste toner contained in the toner conveyance path 37 is conveyed in the axis direction (a direction along the rotary shaft 29*a*) to be discharged to outside the cleaning device 7*a*.

Figure 5:
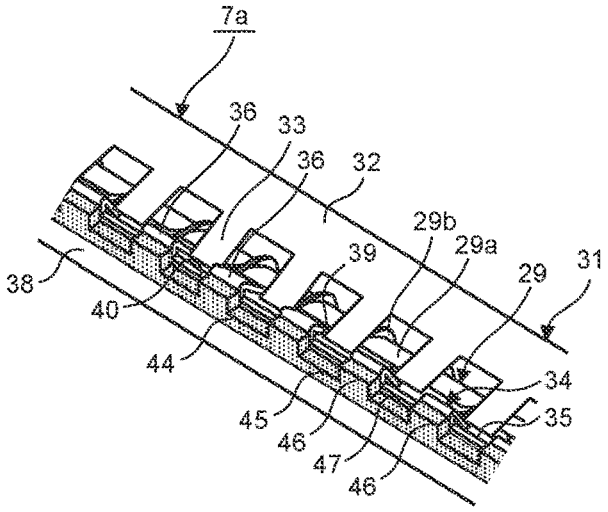
FIG. 5 is a perspective view showing surroundings of a conveyance screw in the cleaning device of the embodiment.
Figure 6:
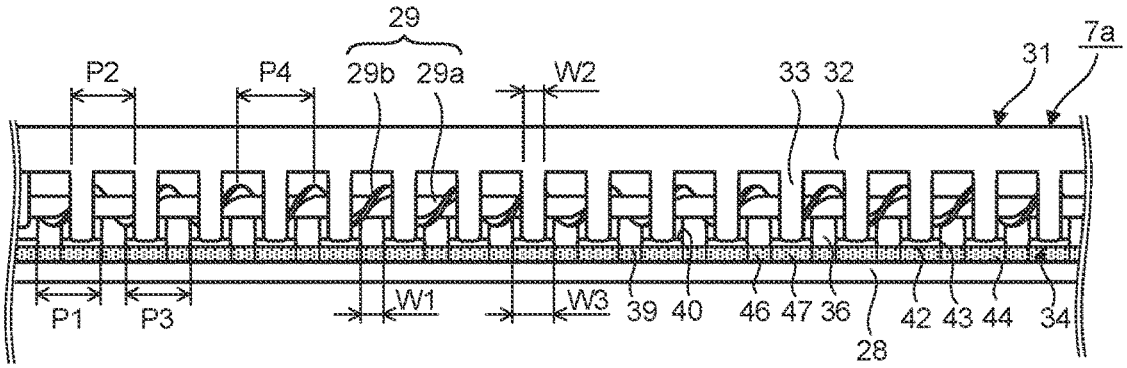
FIG. 6 is a plan view of the surroundings of the conveyance screw in the cleaning device of the embodiment when viewed planarly in a radial direction (a perpendicular direction to a rotary shaft 29).

FIG. 5 is a perspective view showing surroundings of the conveyance screw 29 in the cleaning device 7*a* of the embodiment. FIG. 6 is a plan view of the surroundings of the conveyance screw 29 in the cleaning device 7*a* of the embodiment when viewed planarly in a radial direction (a perpendicular direction to the rotary shaft 29*a*).

As shown in FIG. 4, FIG. 5, and FIG. 6, the first flicker 34 includes a first base portion 35 and a plurality of first contact pieces 36. The first base portion 35 extends in the axis direction parallel to the rotary shaft 29*a* of the conveyance screw 29. The first contact pieces 36 extend from the first base portion 35 toward the conveyance screw 29.

The first base portion 35 is disposed between the rotary shaft 29*a* and the cleaning blade 28 in the horizontal direction. The first base portion 35 includes a secured portion 42, a blade opposed portion 43, a plurality of protrusions 39, and a plurality of waste toner passing concaves 40. The secured portion 42 is secured along an inner wall of the housing 26. The blade opposed portion 43 extends upward from the secured portion 42. The protrusions 39 and the waste toner passing concaves 40 are formed at an upper end part of the blade opposed portion 43.

The secured portion 42 is positioned between the rotary shaft 29*a* and the cleaning blade 28 together with the opening 30 in the horizontal direction. The secured portion 42 is stacked on a face of the blade securing wall 38 near the toner conveyance path 37, and a lower end part thereof is secured with a securing means such as an adhesive to a flicker securing portion 48 protruding downward from a lower end part of the housing 26. The securing means is not limited to an adhesive, and, for example, the lower end part of the secured portion 42 may be held between the blade securing wall 38 and the flicker securing portion 48 and secured with a fastening member such as a bolt.

The blade opposed portion 43 extends upward from the secured portion 42 toward the opening 30 (see FIG. 3). The blade opposed portion 43 is opposed to the cleaning blade 28 in the horizontal direction. The plurality of protrusions 39 protrude from an upper end of the blade opposed portion 43 toward the opening 30 at given intervals along the axis direction.

The first contact pieces 36 are connected to upper end parts of the protrusions 39 and bent downward therefrom to extend toward an outer circumferential surface of the conveyance screw 29. The first contact pieces 36 are provided over an entire region of the conveyance screw 29 in the axis direction (see FIG. 6). The waste toner passing concaves 40 are concaved downward from an upper end part of the blade opposed portion 43 (see FIG. 4). The waste toner passing concaves 40 are each formed between every adjacent pair of the first contact pieces 36 (see FIG. 5 and FIG. 6).

Here, FIG. 4 shows a pair of tangents (a first tangent L1, a second tangent L2) to the conveyance screw 29 passing through the distal end part 28*a* of the cleaning blade 28. Waste toner removed from the photosensitive drum 1*a* passes through a region between the first tangent L1 and the second tangent L2. The waste toner passing concaves 40 are open to a passage path for waste toner removed from the photosensitive drum 1*a*.

As shown in FIG. 4, FIG. 5, and FIG. 6, the second flicker 31 includes a second base portion 32 and a plurality of second contact pieces 33. The second base portion 32 extends in the axis direction parallel to the rotary shaft 29*a* of the conveyance screw 29. At a position opposed to the cleaning blade 28 via the rotary shaft 29*a* in the horizontal direction, the second base portion 32 is secured with an adhesive or the like to an upper part of the inner wall of the housing 26 relative to the rotary shaft 29*a*. The second contact pieces 33 extend from the second base portion 32 toward the conveyance screw 29.

An interval P1 at which the first contact pieces 36 are arranged, an interval P2 at which the second contact pieces 33 are arranged, and an interval P3 at which the waste toner passing concaves 40 are arranged are substantially equal to one another (see FIG. 6). The first contact pieces 36 and the second contact pieces 33 are alternately arranged along the axis direction so as not to overlap each other. The second contact pieces 33 are opposed to the waste toner passing concaves 40 in a direction orthogonal to the rotary shaft 29*a* (an up-down direction shown in FIG. 6).

A width W1 (a length in an extending direction of the first base portion 35) of the first contact pieces 36 and a width W2 (a length in an extending direction of the second base portion 32) of the second contact pieces 33 are substantially equal to each other. The width W1 of the first contact pieces 36 and the width W2 of the second contact pieces 33 are each not more than a pitch P4 of the helical vane 29*b*. Preferably, the width W2 of the second contact pieces 33 has a specific size of, for example, not less than ⅕ of the pitch P4 and not more than ½ of the pitch P4 (see FIG. 6). A width W3 of the waste toner passing concaves 40 in the axis direction is larger than the width W2 of the second contact pieces 33. A thickness of the first contact pieces 36 is substantially equal to a thickness of the second contact pieces 33.

There is no particular limitation on a material of the first contact pieces 36 and the second contact pieces 33 as long as the material is an elastic material that swings upon contact with the helical vane 29*b* of the conveyance screw 29, As the material, there can be used various types of synthetic resin sheets having a reduced friction resistance such as, for example, a polyethylene terephthalate (PET) sheet, a fluororesin sheet, and a polyimide sheet, among which the polyethylene terephthalate sheet is used preferably in terms of cost, durability, and so on.

As shown in FIG. 4, at a position more distant from the opening 30 (see FIG. 3) of the housing 26 than the rotary shaft 29*a* is (a position nearer to the bottom surface 41 of the toner conveyance path 37 than the rotary shaft 29*a* is), the first contact pieces 36 are in contact with a lower part of the conveyance screw 29 relative to the rotary shaft 29*a*. The first contact pieces 36 press the conveyance screw 29 obliquely upward along a first direction d1 away from the bottom surface 41 of the toner conveyance path 37.

In a perpendicular direction, at a position nearer to the opening 30 (see FIG. 3) of the housing 26 than the rotary shaft 29*a* is (a position more distant from the bottom surface 41 of the toner conveyance path 37 than the rotary shaft 29*a* is), the second contact pieces 33 are in contact with an upper part of the conveyance screw 29 relative to the rotary shaft 29*a*. From a position of the contact with the conveyance screw 29, the second contact pieces 33 press the conveyance screw 29 downward along a second direction d2 (such a direction as to approach the bottom surface 41 of the toner conveyance path 37).

The first contact pieces 36 and the second contact pieces 33 have free ends at their distal end parts. As the conveyance screw 29 rotates, the first contact pieces 36 and the second contact pieces 33 swing while being elastically deformed so as to repeatedly assume a state of making contact with the helical vane 29*b* and thus being lifted to be elastically deformed and a state of abutting on the rotary shaft 29*a* under resilience.

In a state where the second contact pieces 33 are lifted by the helical vane 29*b*, the distal end parts of the second contact pieces 33 are positioned within the waste toner passing concaves 40 (see FIG. 4), When the second contact pieces 33 are making contact with the rotary shaft 29*a* under resilience, the distal end parts of the second contact pieces 33 are positioned on outer sides of the waste toner passing concaves 40. When the second contact pieces 33 swing in the above-described manner, the second contact pieces 33 repeatedly go in and out of the waste toner passing concaves 40 without making contact with the first flicker 34.

As shown in FIG. 4, FIG. 5, and FIG. 6, an elastic member 44 is disposed between the blade opposed portion 43 and the cleaning blade 28. The elastic member 44 is positioned at an upper part of the blade securing wall 38. The elastic member 44 is bonded with an adhesive or the like to be secured to a face of the blade opposed portion 43 opposed to the cleaning blade 28. A thickness of the elastic member 44 in the horizontal direction is substantially equal to a distance between the cleaning blade 28 and the blade opposed portion 43.

The elastic member 44 is formed of a sponge body having a cushioning property. The elastic member 44 is made of a polyester-based urethane foam. There may also be used, however, any other material having a nearly equal elastic modulus when the material is identical in shape and volume.

The elastic member 44 includes a base portion 45 extending along the axis direction and a plurality of projections 46 protruding upward from the base portion 45. The base portion 45 is stacked on the blade opposed portion 43 of the first flicker 34, and the projections 46 are stacked on the protrusions 39 of the first flicker 34. That is, the projections 46 are arranged at regular intervals so as to overlap the first contact pieces 36 along the axis direction. Concaves 47 concaved in the perpendicular direction are each formed between each adjacent pair of the projections 46. The concaves 47 overlap the waste toner passing concaves 40 of the first flicker 34 in the axis direction.

As described above, the elastic member 44 is disposed between the blade opposed portion 43 and the cleaning blade 28. Further, the projections 46 of the elastic member 44 are stacked on the protrusions 39 of the first flicker 34. Thus, even when the first contact pieces 36 swing as the conveyance screw 29 rotates, the blade opposed portion 43 connected to the first contact pieces 36 is supported by the elastic member 44. As a result, the blade opposed portion 43 of the first flicker 34 is unlikely to be warped, and thus it is possible to suppress a decrease in pressing force of the first contact pieces 36 with respect to the conveyance screw 29 and thus to suppress a deterioration in scraping-off capability of the first flicker 34.

Furthermore, the elastic member 44 is formed of a sponge body having a cushioning properly. Thus, even when the elastic member 44 makes contact with the cleaning blade 28, so that the cleaning blade 28 is pressed by the blade opposed portion 43 and the elastic member 44, a cushioning effect is brought about by the cushioning property of the elastic member 44 to relatively reduce a pressing force exerted on the cleaning blade 28. As a result, a pressing force of the distal end part 28*a* of the cleaning blade 28 with respect to each of the photosensitive drums 1*a* to 1*d* is stabilized, and thus it is possible to suppress a failure to remove residual toner on the photosensitive drums 1*a* to 1*d* and thus to suppress an image formation failure. Consequently, it is possible to provide the cleaning devices 7*a* to 7*d* capable of suppressing a waste toner discharge failure, while suppressing an image formation failure and the image forming apparatus 100 including the same.

Furthermore, as described above, the conveyance screw 29 is pressed in the first direction d1 directed obliquely upward from the first flicker 34 and pressed in the second direction d2 directed downward from the second flicker 31. Thus, an upwardly acting component force of a pressing force of the first flicker 34 and a downward pressing force of the second flicker 31 are well balanced with each other, so that the conveyance screw 29 is unlikely to be deformed. Accordingly, the conveyance screw 29 is unlikely to make contact with the bottom surface 41 of the toner conveyance path 37, and a phenomenon is unlikely to occur in which the conveyance screw 29 is deformed (upward) toward the opening 30 to widen a clearance between the bottom surface 41 of the toner conveyance path 37 and the outer circumferential surface of the conveyance screw 29. As a result, it is possible to suppress a rotation failure of the conveyance screw 29 and to suppress a phenomenon in which a clearance between the conveyance screw 29 and the bottom surface 41 of the toner conveyance path 37 is widened to allow accumulation and sticking of waste toner therein, thus making it possible to suppress a toner discharge failure.

Furthermore, as described above, the first flicker 34 and the second flicker 31 are configured so that the first contact pieces 36 and the second contact pieces 33 are individually in contact with the conveyance screw 29 from above and below; respectively. Further, the first contact pieces 36 and the second contact pieces 33 are alternately arranged so as not to overlap in the axis direction and thus are not in contact with each other. Thus, it is possible to suppress accumulation and sticking of waste toner between the first flicker 34 and the second flicker 31.

Furthermore, as described above, the plurality of waste toner passing concaves 40 are formed in the blade opposed portion 43. Further, the waste toner passing concaves 40 are open to the passage path (the region between the first tangent L1 and the second tangent L2) for waste toner removed from the photosensitive drum 1*a*. This makes it easier for waste toner removed from the photosensitive drum 1*a* to pass through the waste toner passing concaves 40 to reach the toner conveyance path 37, thus making it possible to suppress a phenomenon in which waste toner is blocked by the protrusions 39 from being introduced into the toner conveyance path 37.

Furthermore, the plurality of concaves 47 formed in the elastic member 44 are disposed so as to overlap the waste toner passing concaves 40 in the axis direction. This makes it easier for waste toner removed from the photosensitive drum 1*a* to pass through the waste toner passing concaves 40 without being interrupted by the elastic member 44.

Furthermore, as described above, the second contact pieces 33 are opposed to the waste toner passing concaves 40 in a direction orthogonal to the axis direction and swing to repeatedly go in and out of the waste toner passing concaves 40. Thus, the second flicker 31 can be disposed as closely as possible to the first flicker 34 while not making contact therewith, so that space saving in the toner conveyance path 37 can be achieved.

Other than the above, the present disclosure is not limited to the foregoing embodiment and can be variously modified without departing from the spirit of the present disclosure. For example, while the foregoing embodiment describes only a configuration including the rubbing roller 27 and the cleaning blade 28 as a polishing system in each of the cleaning devices 7*a* to 7*d*, the configuration of the present disclosure is applicable to cleaning devices having various configurations including the conveyance screw 29, such as a configuration including, as the polishing system, only the cleaning blade 28 or a configuration in which the rubbing roller 27 is replaced with a cleaning roller having only a cleaning function.

Furthermore, while the cleaning devices 7*a* to 7*d* of the foregoing embodiment adopt a configuration including two flickers that are the first flicker 34 and the second flicker 31, it is also possible to adopt a configuration including only the first flicker 34.

Figure 7:
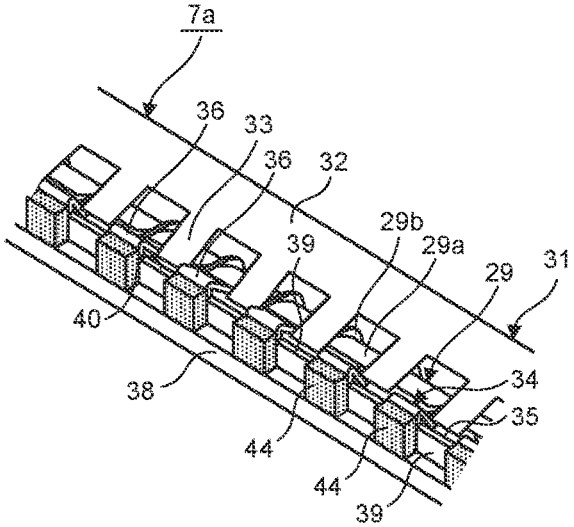
FIG. 7 is a perspective view showing another example of an elastic member of the embodiment.

Furthermore, while in the foregoing embodiment, the elastic member 44 is shown as a single body including one base portion 45 and the plurality of projections 46 provided on the base portion 45 (see FIG. 5), there is no limitation thereto. For example, as shown in FIG. 7 (a perspective view showing another example of the elastic member 44 of the embodiment), a configuration can be adopted in which a plurality of elastic members 44 are disposed between the blade opposed portion 43 and the cleaning blade 28. In this case, the elastic members 44 are disposed at prescribed intervals so as to overlap the protrusions 39 along the axis direction.

Furthermore, while in the foregoing embodiment, the elastic member 44 is configured to be stacked on the blade opposed portion 43 and the protrusions 39, the elastic member 44 may be separated from the first flicker 34 without being stacked on the blade opposed portion 43 and the protrusions 39. In this case, the elastic member 44 can be secured with an adhesive or the like to an upper end part of the blade securing wall 38 or the cleaning blade 28.

Furthermore, while in the foregoing embodiment, a thickness of the elastic member 44 is substantially equal to a distance between the cleaning blade 28 and the blade opposed portion 43, the elastic member 44 can be configured to have a thickness smaller than the distance between the cleaning blade 28 and the blade opposed portion 43. In this case, preferably, the elastic member 44 is stacked on the blade opposed portion 43 and the protrusions 39.

Furthermore, the interval P2 at which the second contact pieces 33 are arranged may be different from the interval P3 at which the waste toner passing concaves 40 are arranged as long as the second contact pieces 33 are opposed to the waste toner passing concaves 40.

The present disclosure is usable in a cleaning device that removes waste toner from a surface of an image carrier and conveys the waste toner thus removed. Through the use of the present disclosure, it is possible to provide a cleaning device capable of effectively preventing solidification of toner and thus maintaining stable toner conveyance capability and an image forming apparatus including the same.

What is claimed is:

1. A cleaning device, comprising:

a housing having an opening that is formed to be opposed to an outer circumferential surface of an image carrier and through which waste toner removed from the outer circumferential surface of the image carrier is introduced inside the housing;

a cleaning blade that protrudes through the opening toward the outer circumferential surface of the image carrier and has a distal end part that abuts on the outer circumferential surface of the image carrier;

a toner conveyance path that is provided in a bottom part of the housing and conveys the waste toner introduced through the opening;

a conveyance screw that includes:

a rotary shaft rotatably supported inside the toner conveyance path; and a helical vane formed on an outer circumferential surface of the rotary shaft; and a first flicker that is provided between the rotary shaft and the cleaning blade in a horizontal direction and includes:

a first base portion extending in a direction of the rotary shaft; and a plurality of first contact pieces extending from the first base portion toward the conveyance screw to abut on a lower part of an outer circumferential surface of the conveyance screw relative to the rotary shaft and arranged along the rotary shaft direction, the first flicker using the first contact pieces to press the conveyance screw in a first direction away from a bottom part of the toner conveyance path, wherein the first base portion includes:

a secured portion secured to an inner wall of the housing; and a blade opposed portion extending upward from the secured portion to be opposed to the cleaning blade in the horizontal direction, the first contact pieces are connected to an upper end part of the blade opposed portion, and an elastic member is disposed between the cleaning blade and the blade opposed portion.

2. The cleaning device according to claim 1, wherein a thickness of the elastic member is substantially equal to a distance between the cleaning blade and the blade opposed portion.

3. The cleaning device according to claim 1, wherein the elastic member is secured to the blade opposed portion.

4. The cleaning device according to claim 1, wherein the elastic member is formed of a sponge.

5. The cleaning device according to claim 1, further comprising:

a second flicker that includes:

a second base portion extending in the rotary shaft direction; and a plurality of second contact pieces extending from the second base portion toward the conveyance screw to abut on an upper part of the outer circumferential surface of the conveyance screw relative to the rotary shaft and arranged along the rotary shaft direction, the second flicker using the second contact pieces to press the conveyance screw in a second direction opposite to the first direction, wherein the first base portion includes:

a plurality of protrusions provided at the upper end part of the blade opposed portion so as to protrude toward the opening and arranged along the rotary shaft direction; and a plurality of waste toner passing concaves concaved from the upper end part of the blade opposed portion in a direction opposite to a protruding direction of the protrusions and arranged so as to alternate with the protrusions along the rotary shaft direction, and the elastic member is positioned at least between the protrusions and the cleaning blade.

6. The cleaning device according to claim 5, wherein the first contact pieces and the second contact pieces are alternately arranged along the rotary shaft direction, a width of the waste toner passing concaves in the rotary shaft direction is larger than a width of the second contact pieces, and the waste toner passing concaves are opposed to the second contact pieces in a direction orthogonal to the rotary shaft.

7. An image forming apparatus, comprising:

an image forming portion that transfers toner on the image carrier onto a recording medium so as to form an image thereon; and the cleaning device according to claim 1.

* * * * *